US007261022B1

(12) United States Patent
Hsieh

(10) Patent No.: US 7,261,022 B1
(45) Date of Patent: Aug. 28, 2007

(54) INSERTION TYPE HAND TOOL

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/397,369

(22) Filed: Apr. 5, 2006

(51) Int. Cl.
*B25B 23/16* (2006.01)
*B25G 1/06* (2006.01)

(52) U.S. Cl. ..... 81/177.75; 81/177.85; 81/177.7; 81/177.8

(58) Field of Classification Search ..... 81/177.75, 81/177.7, 177.8, 177.85, 177.9; 257/750–766, 257/773–776
See application file for complete search history.

(56) References Cited

U.S. PATENT DOCUMENTS

| | | | | | |
|---|---|---|---|---|---|
| 777,955 | A * | 12/1904 | Kanning | 81/177.8 |
| 1,456,290 | A * | 5/1923 | Tell | 81/165 |
| 3,068,728 | A * | 12/1962 | Shephard | 81/177.7 |
| 5,331,869 | A * | 7/1994 | Webb | 81/177.1 |
| 5,561,327 | A * | 10/1996 | Jun | 257/758 |
| 5,792,705 | A | 8/1998 | Wang et al. | |
| 5,840,624 | A | 11/1998 | Jang et al. | |
| 6,016,726 | A * | 1/2000 | Wright | 81/177.7 |
| 6,028,362 | A | 2/2000 | Omura | |
| D442,041 | S * | 5/2001 | Chen | D8/28 |
| 6,412,374 | B1 * | 7/2002 | Hsieh | 81/177.7 |
| 7,018,298 | B1 * | 3/2006 | Chiou | 81/177.75 |
| 7,137,323 | B1 * | 11/2006 | Hsieh | 81/467 |
| 2004/0214646 | A1 * | 10/2004 | Chiou | 464/158 |

FOREIGN PATENT DOCUMENTS

| | | | |
|---|---|---|---|
| EP | 191913 | A2 * | 8/1986 |
| EP | 308968 | A1 * | 3/1989 |

* cited by examiner

*Primary Examiner*—Hadi Shakeri

(57) ABSTRACT

An insertion type hand tool comprises a tool body having a handle and a connecting portion extended from the handle; the connecting portion having a combining groove; a driving portion having an engaging end corresponding to the connecting portion; at least one side of the engaging end being formed with an inclined side for resisting against the combining groove of the connecting portion so that the orientation of the driving portion is adjustable with respect to the connecting portion; one side of the engaging end near the driving portion having a flat side; the flat side being adjacent with an inclined side; and an elastic unit is installed in the engaging end of the driving portion so as to be positioned in a positioning hole of the connecting portion.

2 Claims, 6 Drawing Sheets

INSERTION TYPE HAND TOOL

FIELD OF THE INVENTION

The present invention relates to hand tools, and in particular to an insertion type hand tool, wherein a connecting portion is pivotally installed to a handle and a driving portion is adjustably installed to the connecting portion so that the driving portion can be adjusted in two directions.

BACKGROUND OF THE INVENTION

In the prior art, the handle and the head of a hand tool are arranged at the same plane and the handle is non-rotatable with respect to the head so that the orientation of the head with respect to the handle is unadjustable. However if the work environment is not so suitable for locating the hand tool, the hand tool cannot be operated conveniently.

Therefore, in one improvement, the head is folded with respect to the handle with a predetermined angle. However the bending angle between the handle and the head is fixed, Thus it is only suitable for some specific work environments.

Thus there are other hand tools being developed for overcoming the defect in the prior art designs, however all these hand tools can only make the head pivotally rotates with respect to the handle in one orientation, but it cannot rotate along a different orientation. Thereby the head is fixedly installed to the handle. It is un-replaceable. Thus if the driven object (for example a screw) is not suitable for the hand tool, another kind of hand tool must be prepared. Thus the use of the prior art is limited.

SUMMARY OF THE INVENTION

Accordingly, the primary object of the present invention is to provide an insertion type hand tool, wherein a connecting portion is pivotally installed to a handle and a driving portion is adjustably installed to the connecting portion so that the driving portion can be adjusted in two directions.

To achieve above objects, the present invention provides an insertion type hand tool which comprises a tool body having a handle and a connecting portion extended from the handle; the connecting portion having a combining groove; a driving portion having an engaging end corresponding to the connecting portion; at least one side of the engaging end being formed with an inclined side for resisting against the combining groove of the connecting portion so that the orientation of the driving portion is adjustable with respect to the connecting portion; one side of the engaging end near the driving portion having a flat side; the flat side being adjacent with an inclined side; when the driving portion is completely inserted into the combining groove; the flat side resisting against an inner wall of the combining groove, when the driving portion is pulled for changing the orientation of the driving portion, the inclined side resists against the inner wall of the combining groove; and an elastic unit is installed in the engaging end of the driving portion so as to be positioned in a positioning hole of the connecting portion.

The various objects and advantages of the present invention will be more readily understood from the following detailed description when read in conjunction with the appended drawing.

DETAILED DESCRIPTION OF THE INVENTION

Figure 1:
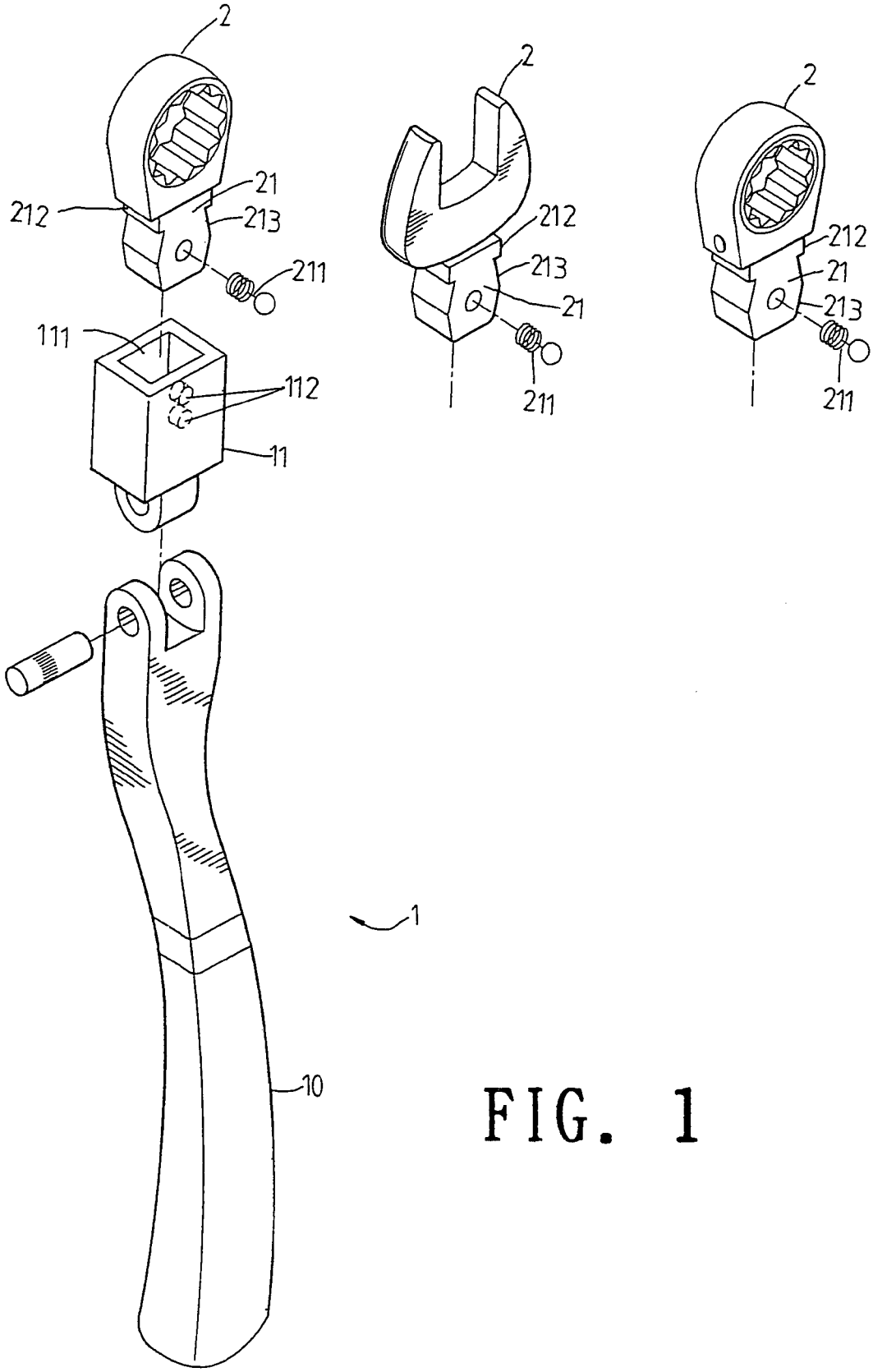
FIG. 1 is an exploded perspective view of the insertion type hand tool of the present invention.
Figure 2:
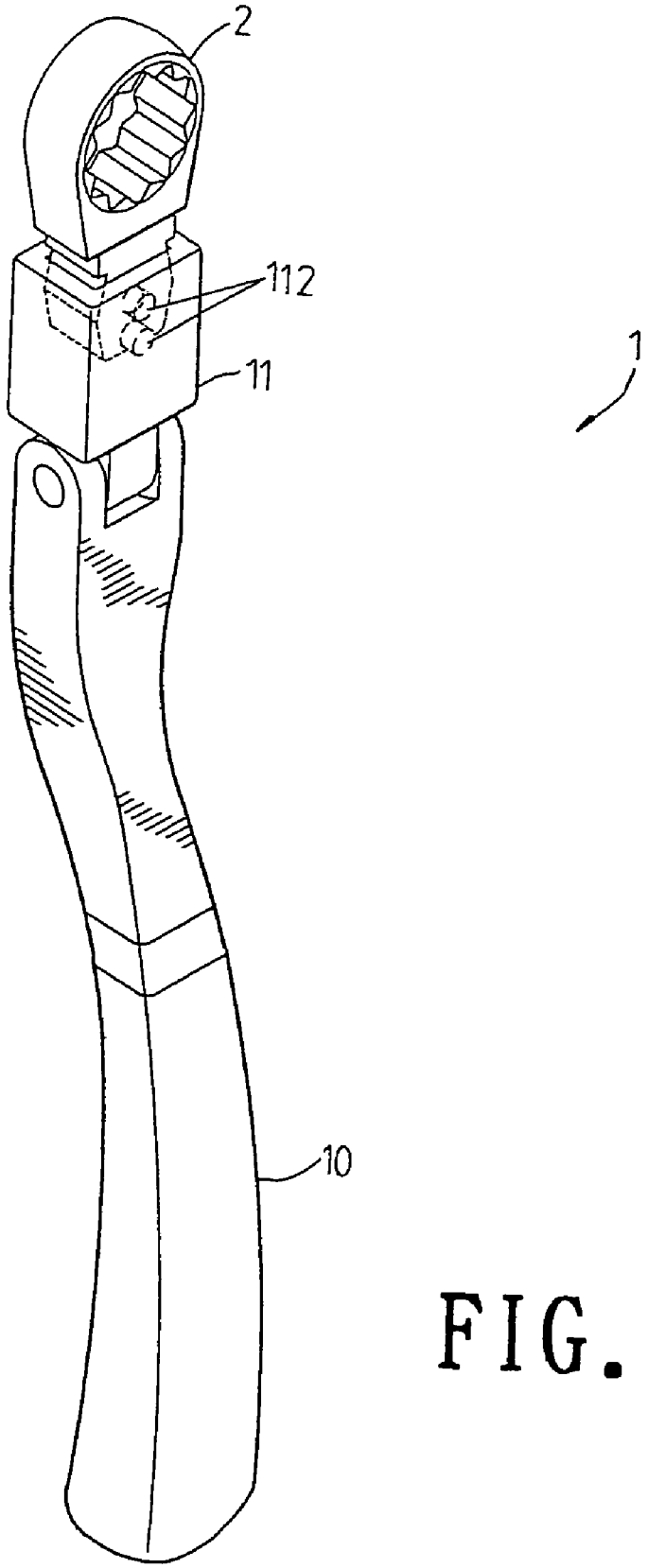
FIG. 2 is a perspective view of the insertion type hand tool of the present invention.
Figure 3:
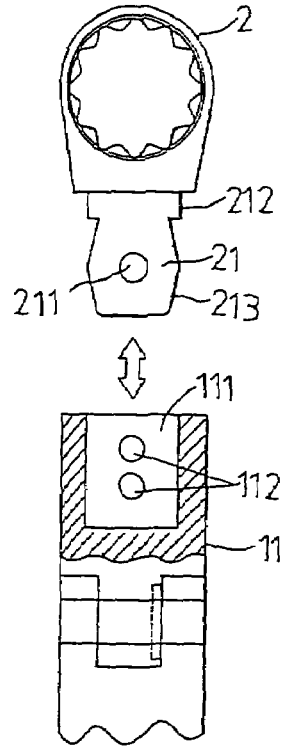
FIG. 3 is an assembled cross sectional view of the insertion type hand tool of the present invention.
Figure 4:
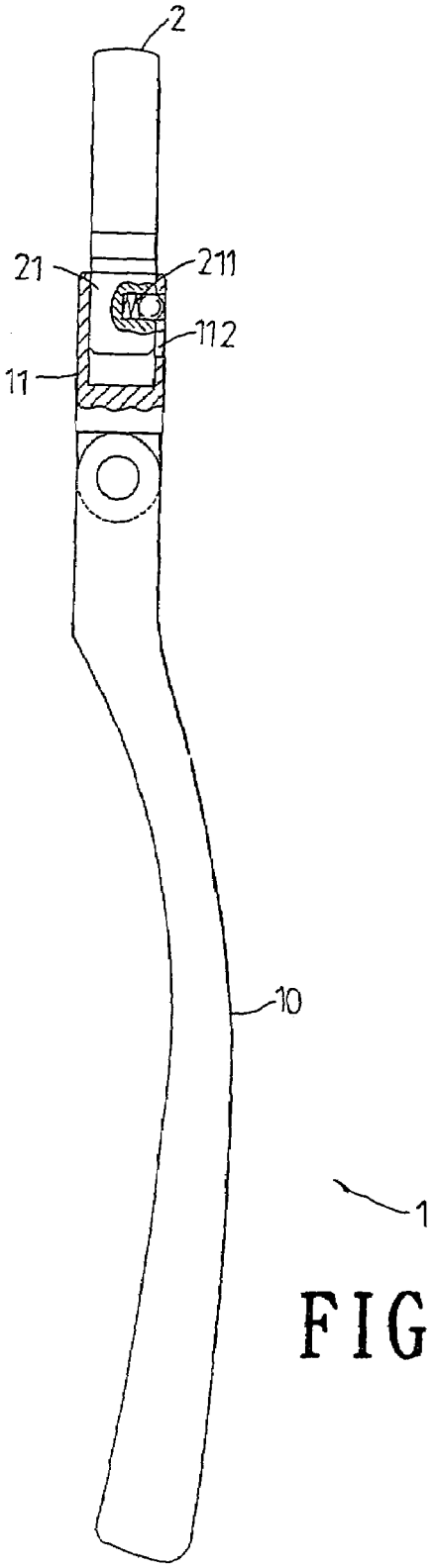
FIG. 4 is a schematic cross sectional view of the insertion type hand tool of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the present invention is illustrated. The present invention mainly includes a tool body 1 and a plurality of driving portions 2 which may have a form of a ring driving portion, an open ended driving portion, or a ratched wheel driving portion, etc. The present invention has the following elements.

The tool body 1 has a handle 10. One end of the handle 10 is pivotally installed with a connecting portion 11. A front end of the connecting portion 11 has a combining groove 111. An inner side of the combining groove 111 has two positioning holes 112 which are arranged longitudinally. The handle 10 has a U shape portion at an upper side thereof, each of two sides of the U shape portion has a hole; a lower end of the connecting portion 11 is extended with a protrusion with a through hole; a shaft passes through the holes of the U shape portion and the through hole of the connection portion 11 so as to pivotally install the connecting portion 11 to the handle 10.

One end of the driving portion 2 is formed as an engaging end 21. The engaging end 21 is installed with an elastic unit 211. In this embodiment, the elastic unit 211 is formed by a steel ball and a spring. The elastic unit 211 can be buckled to any of the two positioning holes 112 so as to combine the driving portion 2 with the tool body 1. Each of two opposite sides of the engaging end 21 near the driving portion 2 has a flat side 212. Each of the flat side 212 is extended with two inclined sides 213. The two inclined sides 213 are formed as a V shape. The flat sides 212 and inclined sides 213 serve to resist against the combining groove 111 of the connecting portion 11 in engagement.

In use of the present invention, referring to FIGS. 5 to 8, other than the connecting portion 11 being capable of pivotally rotating with respect to the handle 10, the driving portion 2 can swing with respect to the connecting portion 11.

Figure 5:
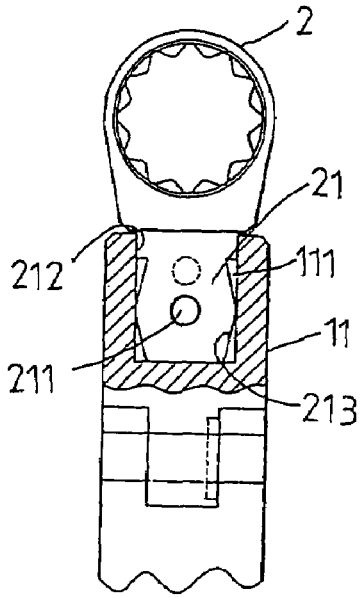
FIG. 5 is a schematic cross sectional view showing the use of the insertion type hand tool of the present invention.

With reference to FIG. 5, in use, the engaging end 21 of the driving portion 2 is inserted into the combining groove 111 of the connecting portion 11. The elastic unit 211 of the driving portion 2 is engaged into one positioning hole 112 of the connecting portion 11. The flat sides 212 resist against an inner side of the combining groove 111 so that the driving portion 2 and the tool body 1 are at the same axial direction.

Figure 6:
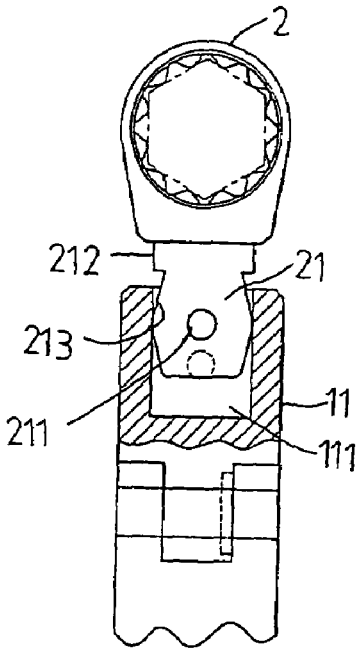
FIGS. 6 to 8 are a cross sectional views showing the adjustment of the insertion type hand tool of the present invention.
Figure 7:
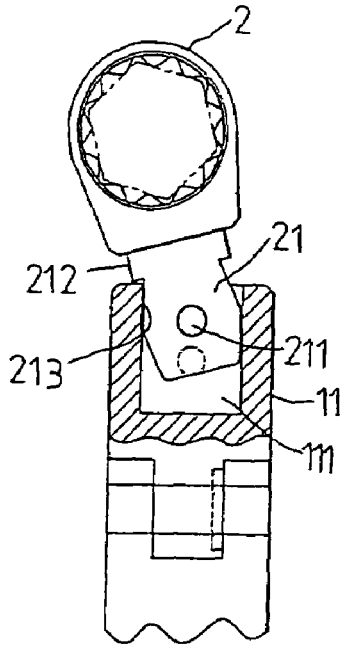
Figure 8:
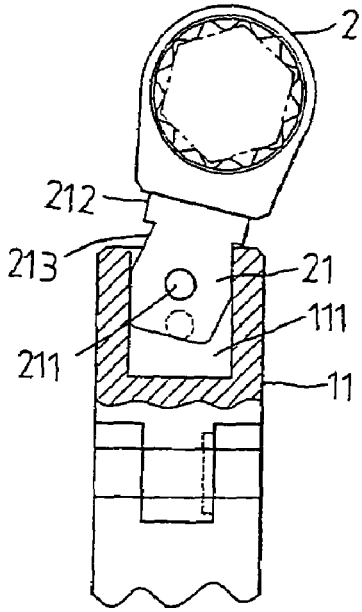

If it is desired to adjust the driving portion 2 to swing along the elastic unit 211 so as to match a work environment, as shown in FIG. 6, the engaging end 21 of the driving portion 2 is pulled out with a predetermined length, so that the flat side 212 protrudes from the combining groove 111 so as to be positioned in another upper positioning hole 112. Then inclined sides 213 resist against the inner wall of the combining groove 111, as shown in FIGS. 7 and 8. Thus the adjustment of the driving portion 2 is achieved.

Referring to FIGS. 9 to 14, the second embodiment of the present invention is illustrated. Those identical to the first embodiment will not be described. Only those differences are described.

Figure 9:
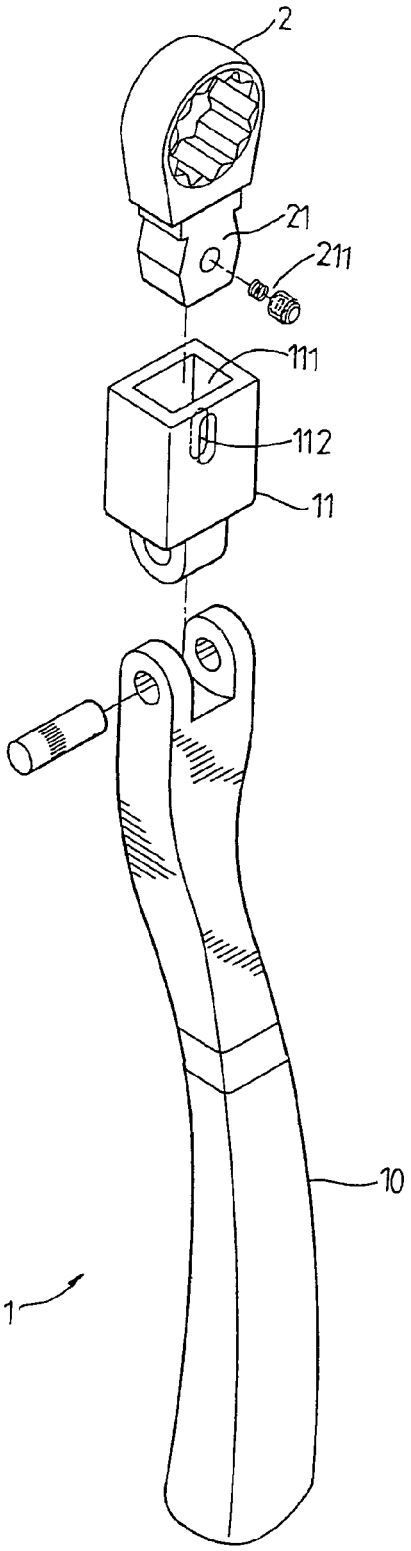
FIG. 9 is an exploded perspective view of the second embodiment of the present invention.
Figure 10:
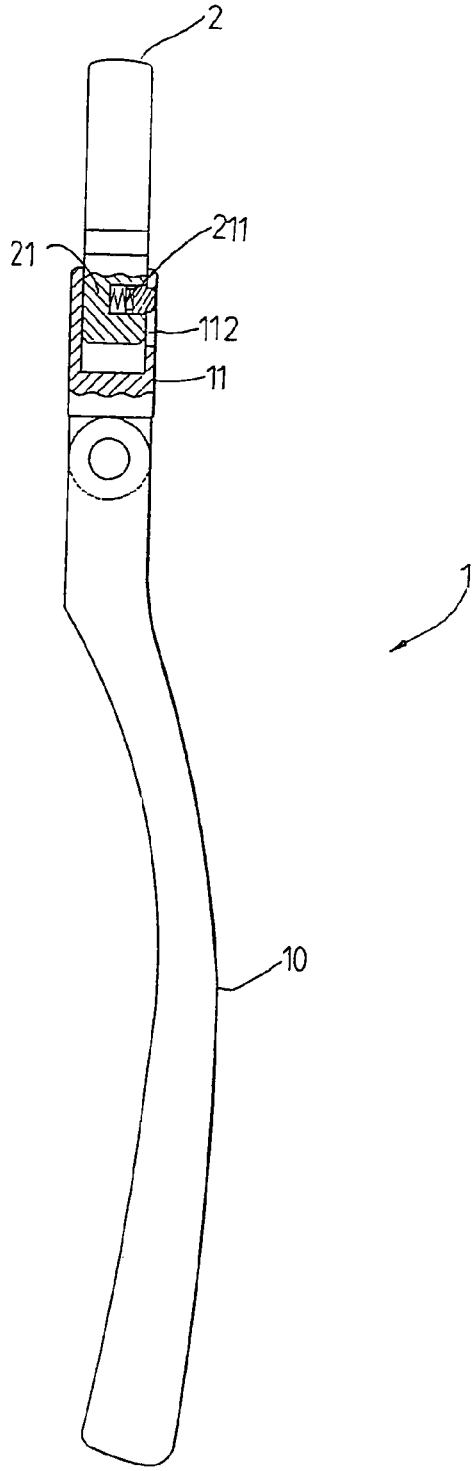
FIG. 10 is a schematic cross sectional view of the second embodiment of the present invention.
Figure 12:
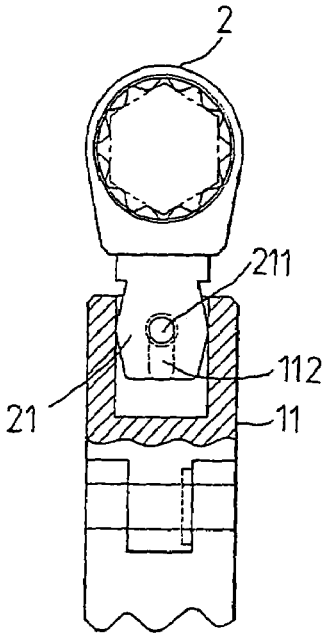
FIGS. 11 to 14 is a schematic cross sectional view showing the adjustment of the insertion type hand tool in the second embodiment of the present invention.
Figure 13:
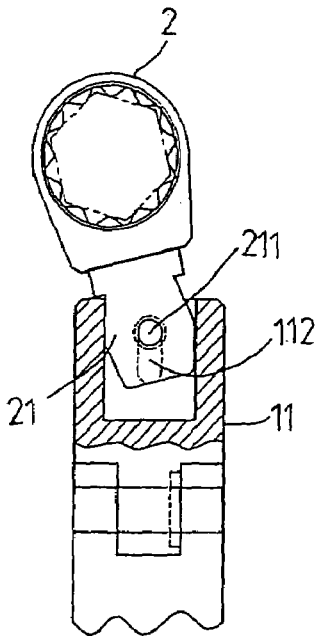
Figure 14:
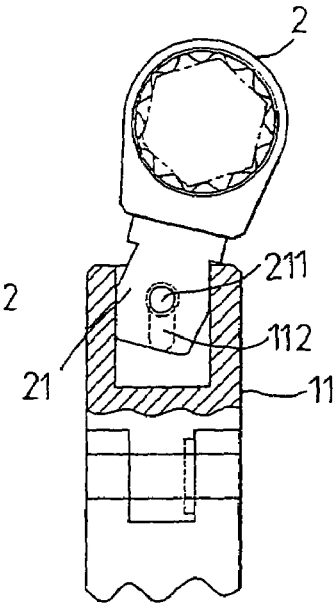
Figure 11:
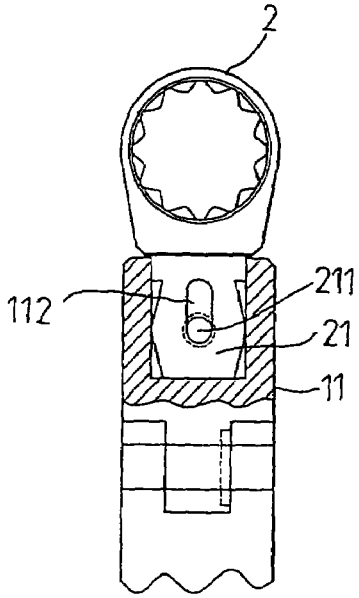

In FIG. 9, it is illustrated that the elastic unit 211 is formed by a spring with a pin 21. Thereby the positioning hole 112 is formed as an elliptical hole. The longitudinal side of the elliptical hole is arranged along the axis from the handle 10 and the driving portion 2 so as to provide a moving space to the driving portion 2. Thus, as illustrated in FIGS. 12 to 14, in operation, the driving portion 2 can be pulled out so that the inclined side 213 of the engaging end 21 resist against an inner wall of the combining groove 111.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An insertion type hand tool comprising:

a tool body having a handle and a connecting portion extended from the handle; the connecting portion having a rectangular combining groove; wherein the handle has a U shape portion at an upper side thereof, each of two sides of the U shape portion has a hole; a lower end of the connecting portion is extended with a protrusion with a through hole; a shaft passes through the holes of the U shape portion and the through hole of the connection portion so as to pivotally install the connecting portion to the handle;

a driving portion having an engaging end corresponding to the connecting portion; each of the two opposite lateral sides of the engaging end being formed with two inclined sides forming a V shape for resisting against an inner wall of combining groove of the connecting portion so that the orientation of the driving portion is adjustable with respect to the connecting portion; each lateral side of the engaging end near the driving portion having a flat side, the flat side being adjacent with a respective inclined side so that when the driving portion is completely inserted in the combining groove, the flat sides resisting against an inner wall of the combining groove and when the driving portion is pulled for changing the orientation of the driving portion, the inclined sides resist against the inner wall of the combining groove;

an elastic unit is installed in the engaging end of the driving portion so as to be positioned in a positioning hole of the connecting portion; and wherein the connecting portion has two positioning holes for receiving the elastic unit in different positions of the driving portion.

2. An insertion type hand tool comprising:

a tool body having a handle and a connecting portion extended from the handle; the connecting portion having a rectangular combining groove; wherein the handle has a U shape portion at an upper side thereof, each of two sides of the U shape portion has a hole; a lower end of the connecting portion is extended with a protrusion with a through hole; a shaft passes through the holes of the U shape portion and the through hole of the connection portion so as to pivotally install the connecting portion to the handle;

a driving portion having an engaging end corresponding to the connecting portion; each of the two opposite lateral sides of the engaging end being formed with two inclined sides forming a V shape for resisting against an inner wall of combining groove of the connecting portion so that the orientation of the driving portion is adjustable with respect to the connecting portion; each lateral side of the engaging end near the driving portion having a flat side, the flat side being adjacent with a respective inclined side so that when the driving portion is completely inserted in the combining groove, the flat sides resisting against an inner wall of the combining groove and when the driving portion is pulled for changing the orientation of the driving portion, the inclined sides resist against the inner wall of the combining groove;

an elastic unit is installed in the engaging end of the driving portion so as to be positioned in a positioning hole of the connecting portion; and wherein the connecting portion has an elliptical hole for receiving the elastic unit in different positions of the driving portion.

* * * * *